US005206695A

United States Patent [19]

Iwata

[11] Patent Number: 5,206,695

[45] Date of Patent: Apr. 27, 1993

[54] IMAGE FORMING APPARATUS HAVING SORTING FUNCTION

[75] Inventor: Yasuhiro Iwata, Yokohama, Japan

[73] Assignee: Kabushiki Kaisha Toshiba, Kawasaki, Japan

[21] Appl. No.: 757,906

[22] Filed: Sep. 11, 1991

[30] Foreign Application Priority Data

Oct. 31, 1990 [JP] Japan ..... 2-293896

[51] Int. Cl.[5] ..... G03G 21/00

[52] U.S. Cl. ..... 355/323; 271/290; 271/298; 355/313

[58] Field of Search ..... 271/289, 290, 298; 270/258; 355/308, 307, 313, 321, 322, 323

[56] References Cited

U.S. PATENT DOCUMENTS

| | | | |
|---|---|---|---|
| 4,502,776 | 3/1985 | Matsumoto et al. | 355/323 |
| 4,693,590 | 8/1987 | Umeda | 355/313 |
| 4,757,356 | 7/1988 | Garofalo | 355/323 |
| 4,913,426 | 4/1990 | Kaneko | 271/296 |

*Primary Examiner*—Michael L. Gellner
*Assistant Examiner*—P. J. Stanzione
*Attorney, Agent, or Firm*—Foley & Lardner

[57] ABSTRACT

An image forming apparatus is disclosed. In this apparatus, setting of documents on a document table, and designation of a numeric value more than "1" as the number of copies are detected. In accordance with this detection, a message for inquiring whether to set a sort/stack mode is displayed. An operation is started in accordance with a mode designated by a user in response to this display.

9 Claims, 20 Drawing Sheets

IMAGE FORMING APPARATUS HAVING SORTING FUNCTION

BACKGROUND OF THE INVENTION

1. Field of the Invention

The present invention relates to an image forming apparatus such as an electronic copying machine having, e.g., an automatic document feeder (ADF) and a sorting unit.

2. Description of the Related Art

In a conventional electronic copying machine, in order to improve the efficiency of various types of copy operations, a return automatic document feeder designed for single-sided or double-sided documents and a sorter for automatically performing a collect operation (sort operation, including a stack operation, are connected to the main body.

The need for such an electronic copying machine has recently increased with an increase in the amount of documents to be processed and a demand for less processing time.

In an electronic copying machine having a return automatic document feeder and a sorter, shown, for example, in U.S. Pat. No. 4,913,426, a sort mode is not selected unless an operator designates it by operating a specific key.

When a plurality of paper sheets for copy processing (a plurality of copies) are set, and a copy operation is to be performed by using an ADF, however, there is a considerably higher probability that an operator selects the sort mode. In this case, no problem will occur even if the sort mode is selected in a case where a single copy is to be formed. That is, the probability of performing the copy operation is substantially great in a case when the sort mode is selected. However, since the sort mode is never selected when no instruction is made by the operation. It is not possible to have a situation in which the operator tends to forget the setting of the sort mode.

As described above, in a conventional electric copying machine, it is difficult to properly determine the need for the sort mode and automatically set the sort mode.

SUMMARY OF THE INVENTION

It is, therefore, an object of the present invention to provide an image forming apparatus which can properly set a sort/stack mode and can efficiently execute an image forming operation.

In order to achieve the above object, according to the present invention, there is provided an image forming apparatus comprising a platen on which a document having an image is placed; means for forming image information on image forming media from the image of the document on the platen; a plurality of bins for receiving the image forming media; sorting means for sorting the image forming media having the image information formed thereon by said image forming means to the plurality of bins; means for stacking the image forming media having the image information formed thereon by said image forming means at a predetermined bin of the plurality of bins; means for feeding the documents onto the platen from a document setting position for setting the documents; means for detecting that the documents are set on said document setting position; and means for inquiring whether to sort the image forming media by the sorting means instead of stacking the image forming media by the stacking means, when said detecting means detects that the documents are set on said document setting position.

According to the present invention, since the sort/stack mode can be automatically set by the abovedescribed means in accordance with the need for the mode, a more efficient operation can be performed.

Addition objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An embodiment of the present invention will be described below with reference to the accompanying drawings.

Figure 1:
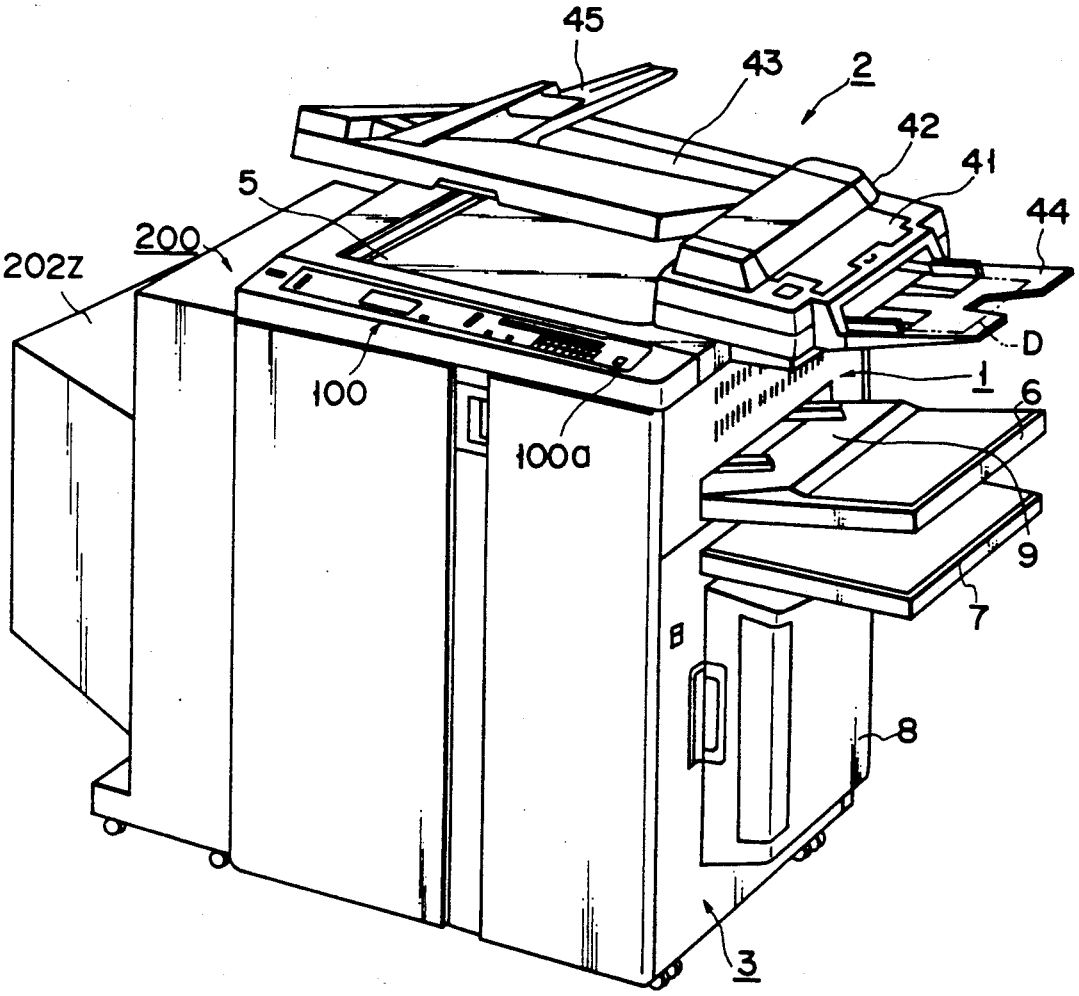
FIG. 1 is a perspective view showing an outer appearance of an electronic copying machine as an image forming apparatus.
Figure 2:
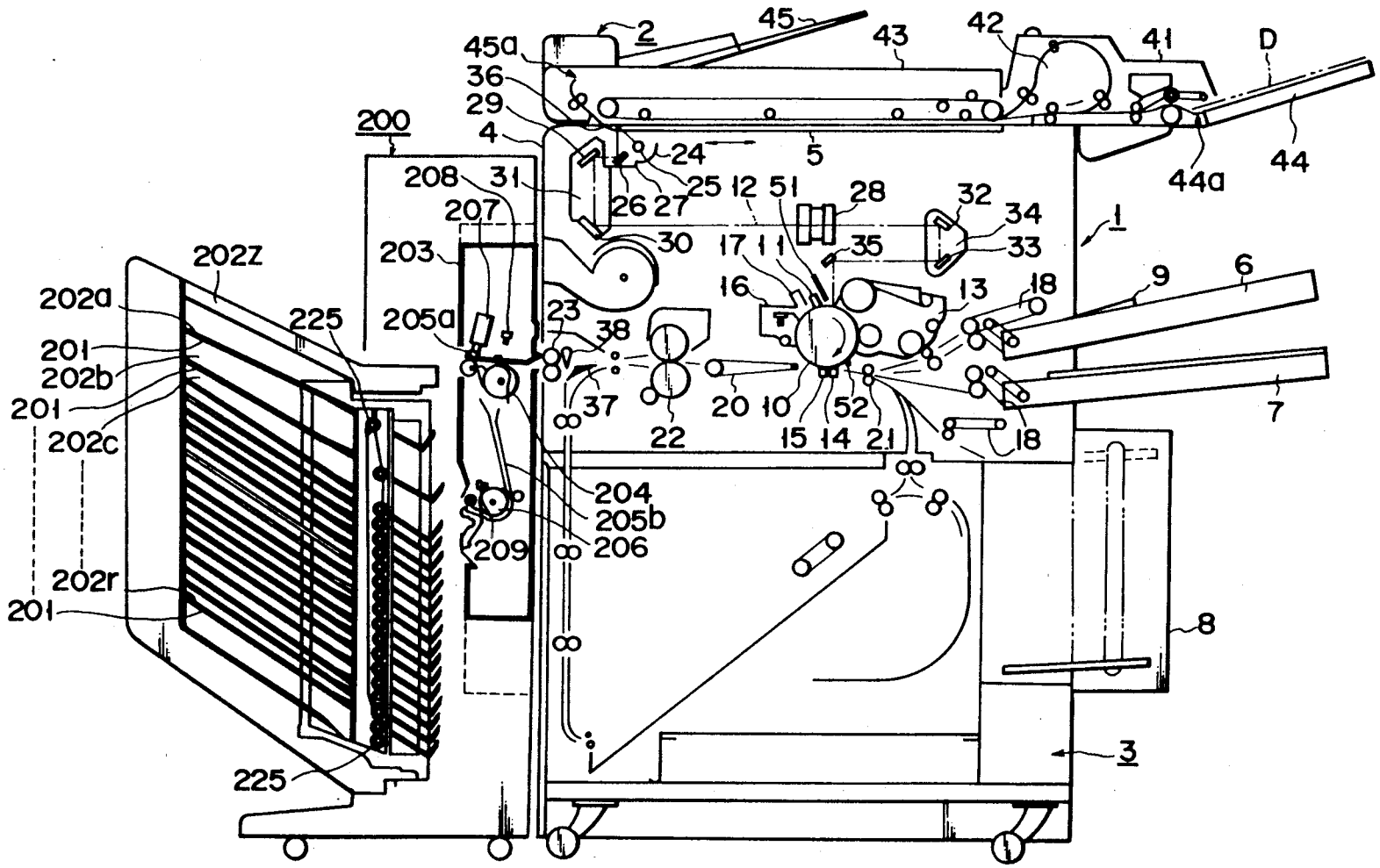
FIG. 2 is a view showing an arrangement of the image forming apparatus in FIG. 1.

FIGS. 1 and 2 show a schematic arrangement of an electronic copying machine as an image forming apparatus of the present invention.

This electronic copying machine comprises a main body 1, a return automatic document feeder (RADF) 2, arranged on the upper surface of the main body 1 to be freely opened/closed, for automatically feeding documents, a direction change convey unit 3, also serving as a mount base on which the main body 1 is mounted, for receiving a paper sheet, exhausted from an exhaust portion of the main body 1, as needed, and guiding the papersheet to a feed portion of the main body in this state or a reversed state to perform a multiple copy operation or a double-sided copy operation with respect thereto, and a sorter (sorting unit) 200, detachably fixed to the main body 1, for sorting and stacking paper sheets, exhausted from the exhaust portion of the main body 1, as needed.

The main body 1 has the following arrangement.

A document table (transparent glass) 5 is fixed on the upper surface of a casing 4, and the RADF 2 is arranged on the document table 5 to cover its upper surface as freely opened/closed. A document is automatically fed to an exposure position on the document table 5 by the RADF 2.

Paper feed cassettes 6 and 7 are detachably fitted in the right side of the casing 4. In addition, a large-capacity paper feed unit 8 is arranged on the right side of the direction change convey unit 3. The cassette cover of the upper paper feed cassette 6 serves as a manual feed table 9 for manually inserting and feeding a paper sheet as needed.

A drum-like photosensitive member 10 as an image carrier is arranged at substantially the center of the casing 4. The following components are sequentially arranged around the photosensitive member 10: a charger 11, an LED erase array 51, an exposure optical system 12, a developing unit 13, a pre-transfer charge removal lamp 52, a transfer charger 14, a separation charger 15, a cleaner 16 and a charge removal lamp 17.

A paper convey path 20 is formed in a lower portion of the casing 4 to guide paper sheets fed from the paper feed cassettes 6 and 7 and from the large-capacity paper feed unit 8 through paper feed means 18, paper sheets manually inserted and fed from the manual feed table 9, and paper sheets guided from the direction change convey unit 3 to the sorter 200, arranged on the left surface of the casing 4, through an image transfer portion between the photosensitive member 10 and the transfer charger 14. A registration roller pair 21 is arranged on the upstream side of the image transfer portion on the paper convey path 20, while a fixing unit (heat rolers) 22 and a paper exhaust roller pair 23 are arranged on the downstream side of the image transfer portion.

The exposure optical system 12 comprises: an exposure lamp 25 having a rear portion enclosed with a reflector 24, for radiating light on a document on the document table 5; a first optical unit 27 having a first mirror 26 for reflecting light, reflected by the document on the document table 5, in a predetermined direction and capable of reciprocating along the document table 5; a second optical unit 31 which is moved in the same direction as that of the first optical unit 27 in synchronism therewith at a speed ½ that of the first optical unit 27, and has second and third mirrors 29 and 30 for reflecting the light, reflected by the first mirror 26, toward a variable-magnification lens unit 28; a third optical unit 34 which has fourth and fifth mirrors 32 and 33, arranged behind the lens unit 28, for reflecting the light emerging from the lens unit 28 in a predetermined direction and is moved in accordance with a set magnification; and a sixth mirror 35 for reflecting the light reflected by the third optical unit 34 toward the photosensitive member 10.

Note that reference numeral 36 denotes a document stopper, arranged at the left end portion of the document table 5, for stopping a document conveyed by the RADF 2 at a predetermined position (exposure position) on the document table 5. The document stopper 36 is vertically moved by a stopper solenoid (not shown).

In this arrangement, the photosensitive member 10 is rotated in a direction indicated by an arrow in FIG. 2, and its surface is uniformly charged by the charger 11. Thereafter, a non-image portion is exposed by the LED erase array 51 to be charge-removed. While the exposure lamp 25 is kept ON, the first optical unit 27 is moved along the document table 5, and the second optical unit 31 is moved in the same direction as that of the first optical unit 27 in synchronism therewith at a speed of ½ that of the first optical unit 27, thus scanning the document set on the document table 5. The image of the document is then formed on the photosensitive member 10 by the exposure optical system 12. As a result, an electrostatic latent image having a potential corresponding to the amount of light emitted from the exposure lamp 25 and the density of the document is formed on the surface of the photosensitive member 10.

The electrostatic latent image formed on the photosensitive member 10 opposes the developing unit 13. As a result, a toner is attached to the electrostatic latent image, and the image is developed. Subsequently, the surface potential of the photosensitive member 10 is uniformly dropped by the pre-transfer charge removal lamp 52, and the toner image on the photosensitive member 10 is moved to the image transfer portion opposite to the transfer charger 14 to be transferred onto a paper sheet fed through the registration roller pair 21. The paper sheet on which the toner image is transferred is separated from the surface of the photosensitive member 10 by the separation charger 15. The paper sheet is then guided to the fixing unit 22 through the paper convey path 20. The toner image is fixed by the fixing unit 22. The paper sheet is then exhausted to the sorter 200 through the paper exhaust roller pair 23.

After the toner image is transferred onto the paper sheet, the surface of the photosensitive member 10 is caused to oppose the cleaner 16 to remove the residual toner therefrom. The photosensitive member is chargeremoved by the charge removal lamp 17 to be prepared for the next copy operation.

When a multiple copy operation (superposition) or a double-sided copy operation is to be performed, a selector gate 37 arranged in front of the paper exhaust roller pair 23 and a paper exhaust detecting switch 38 is switched to temporarily guide the image-fixed paper sheet to the direction change convey unit 3 without discharging it to the sorter 200. The paper sheet is then fed to the photosensitive member 10 again in this state or a reversed state.

The RADF 2 comprises a feed section 41 for separating and feeding a plurality of documents D, collectively set on a paper feed tray 44, one by one, a reversing section 42 for turning over the document D as needed, and a convey section 43 for conveying the document D fed from the feed section 41 or the reversing section 42 to the exposure position on the document table 5, and exhausting the document D, which is exposed and placed on the document table 5, onto a paper exhaust tray 45.

The convey section 43 is arranged on the document table 5 to be freely opened/closed to also serve as a document table cover.

The sorter 200 comprises a plurality of storage portions, e.g., a first storage portion **202*a*, a second storage portion 202*b*, . . . , an eighteenth storage portion 202*r*, constituted by a large number of bins 201 arranged at predetermined intervals i the vertical direction with the distal ends located above the proximal ends, a paper exhaust tray 202*z* as a non-sort bin arranged above the first storage portion 202*a*, and a guide means 203 for guiding image-fixed paper sheets, exhausted from the exhaust portion of the main body 1, to the respective storage portions 202***a*, 202*b*, . . . , 202*r* and to the paper exhaust tray 202*z*.

The guide means 203 comprises a convey roller 204 for receiving, e.g., an image-fixed paper sheet, a guide member 205*a* for guiding the paper sheet received by the convey roller 204 to the paper exhaust tray 202*z*, a guide member 205*b* for guiding paper sheets received by the convey roller 204 to the respective storage portions 202*a*, 202*b*, . . . , 202*r*, a sorter roller 206 as a discharge roller for exhausting the paper sheets guided by the guide member 205*b* into the respective storage portions 202*a*, 202*b*, . . . , 202*r*, a paper path switching solenoid 207 for switching convey paths to the guide members 205*a* and 205*b*, a non-sort path paper sensor 208 for detecting the passage of a paper sheet guided to the guide member 205*a*, a sort path paper sensor 209 for detecting the passage of a paper sheet guide to the guide member 205*b*, and the like.

Figure 3A:
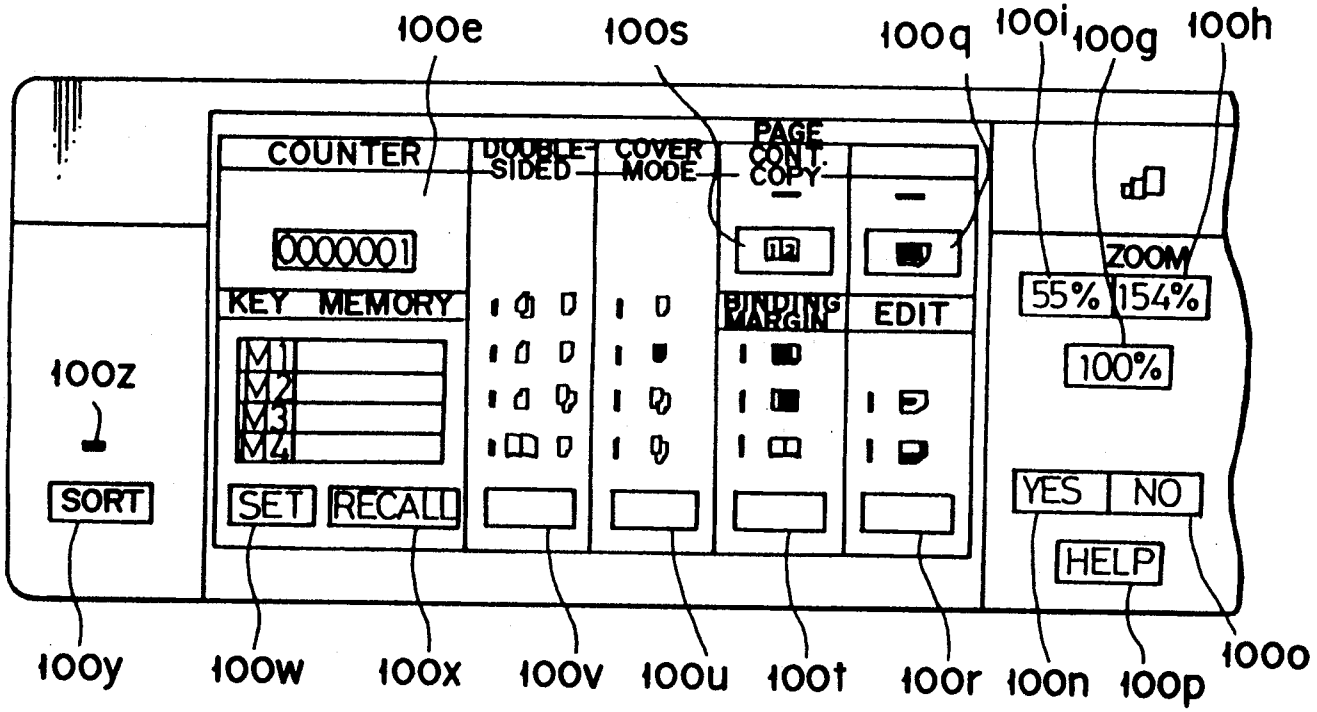
FIGS. 3A and 3B show a plan view showing an arrangement of an operation panel.
Figure 3B:
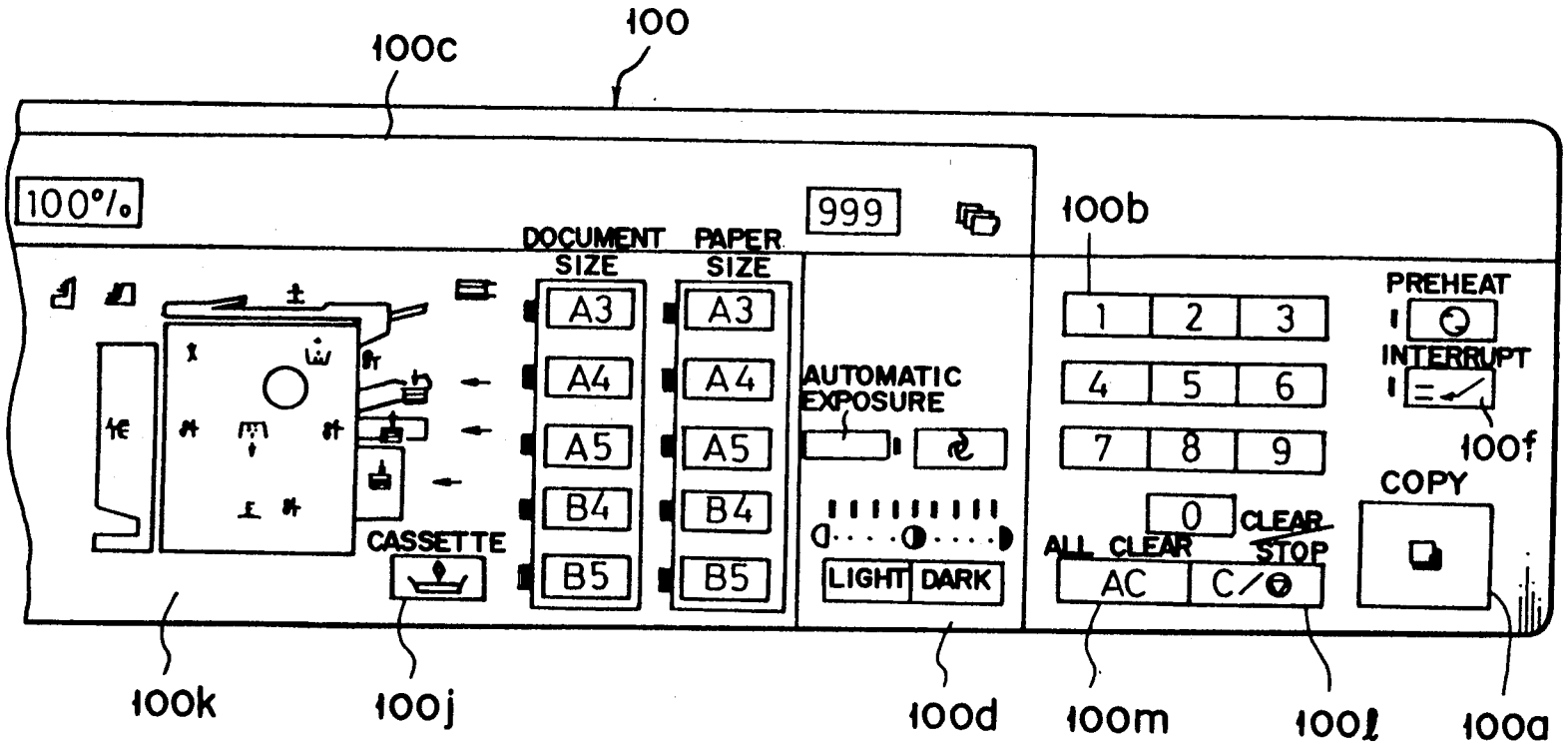

FIGS. 3A and 3B show an operation panel 100 arranged on the main body 1.

This operation panel 100 includes a copy button 100*a* for designating the start of a copy operation, a ten-key pad 100*b* for setting the number of copies and the like, a display unit (liquid crystal panel) 100*c* for displaying a copy magnification, the number of copies, an operation sequence, the states of components, and the like with characters, a density setting section 100*d* for setting a copy density, a counter 100*e* for displaying the total number of copies, an interrupt button 100*f* to be operated to perform a different cop operation in the process of a continuous copy operation, a one-to-one magnification key 100*g* for setting a copy magnification to be a one-to-one magnification (100%), magnification setting keys 100*h* and 100*i* for setting copy magnifications in enlargement and reduction copy operations, a cassette selection button 100*j* for selecting the paper feed cassette 6 or 7 or the large-capacity paper feed unit 8, and a display portion 100*k* on which the operation state of the copying machine or the direction in which a document is placed is displayed.

In addition, the operation panel 100 includes a clear/-stop button 100*l* to be operated to correct the number of copies, an all clear button 100*m* to be operated to return to a normal mode, a YES key (operation guide key) 100*n* for entering a command representing a positive or negative response, a NO key 100*o*, and a HELP key 100*p* to be operated when an operation sequence is unclear, a frame erase button 100*q* for performing a copy operation while erasing a frame, an edit button 100*r* for a trimming or masking copy operation, a page continuous copy button 100*s*, a binding margin button 100*t* to be operated when a binding margin is required, a cover mode button 100*u* to be operated when a cover is required, a double-sided copy button 100*v* for performing a double-sided copy operation, and a SET button 100*w* and a RECALL button 100*x* for setting a copy mode and recalling a copy mode.

Furthermore, a sort key 100*y* is operated to set a sort mode. When the sort mode is selected upon operation of the sort key 100*y*, a display lamp (sort status display lamp) 100*z* is turned on.

Figure 4:
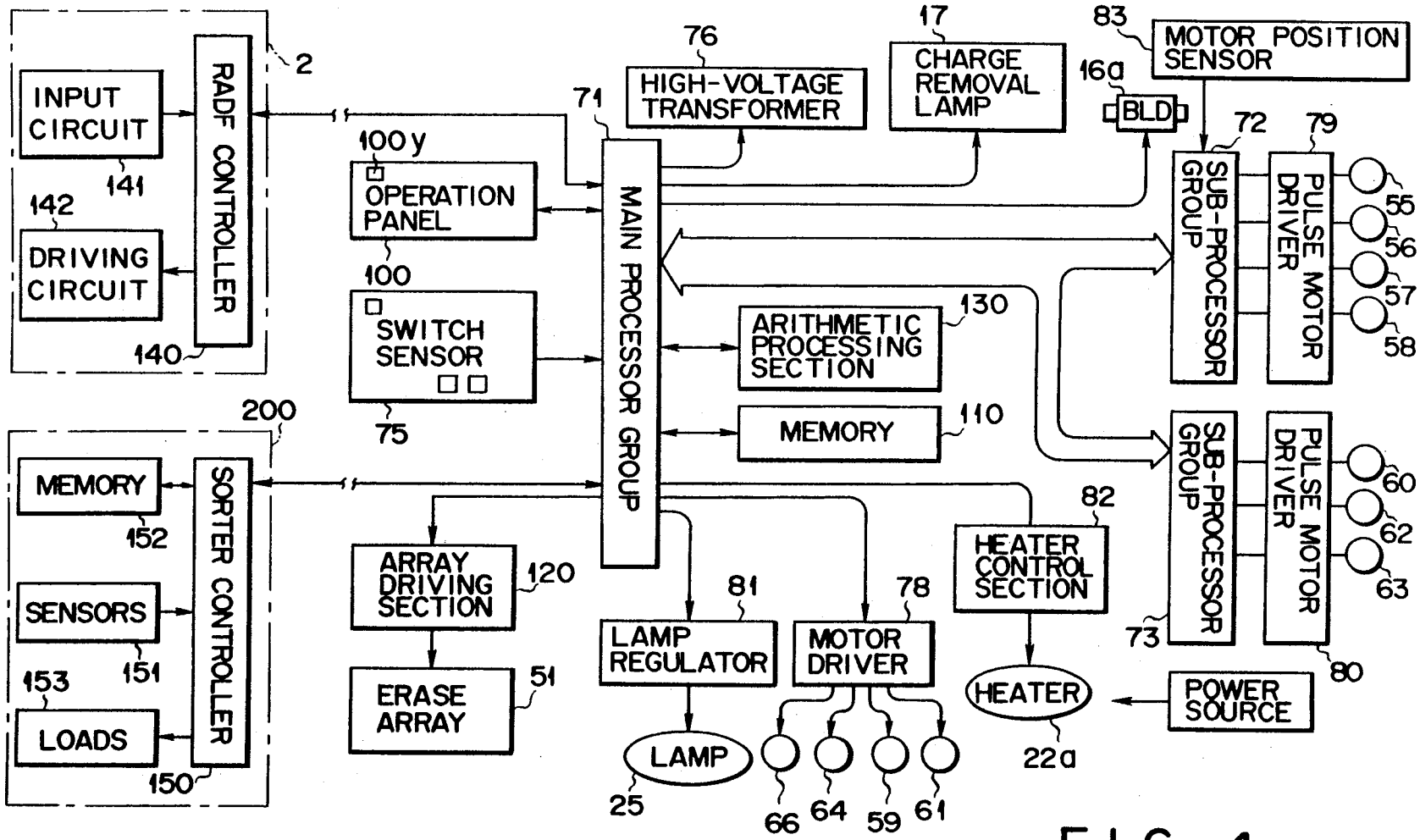
FIG. 4 is a bock diagram showing an overall arrangement of a control circuit.

FIG. 4 shows an overall control circuit.

A main processor group 71 detects input signals from the operation panel 100 and an input unit 75 for various types of switches and sensors to control a high-voltage transformer 76 for driving the respective types of chargers, the charge removal lamp 17, a blade solenoid 16*a* of the cleaner 16, a heater 22*a* of the fixing unit 22, the exposure lamp 25, motors 55 to 66, and the like so as to perform the above-described copying operations, and at the same time, controls a memory 110, the LED erase array 51, an array driving section 120, an arithmetic processing section 130, and the like so as to perform operations in the respective copy modes.

Of the motors 55 to 64, the developing motor 59, the fixing motor 61, the fan motor 64, and a toner motor 66 for supplying a toner to the developing unit 13 are controlled by the main processor group 71 through a motor driver 78. The lens motor 55, the mirror motor 56, the scanning motor 57, and the shutter motor 58 are controlled by a first sub-processor group 72 through a pulse motor driver 79. The drum motor 60, the paper feed motor 62, and the paper convey motor 63 are controlled by a second sub-processor group 73 through a pulse motor driver 80.

The exposure lamp 25 is controlled by the main processor group 71 through a lamp regulator 81. The heater 22*a* is controlled by the main processor group 71 through a heater control section 82.

The main processor group 71 supplies drive/stop commands for the respective motors to the first and second sub-processor groups 72 and 73. The first and second sub-processor groups 72 and 73 supply status signals representing the drive/stop states of the respective motors to the main processor group 71.

The first sub-processor group 72 receives position information from a motor position sensor 83 for detecting the initial positions of the motors 55 to 58. The first and second sub-processor groups 72 and 73 are constituted by, e.g., microcomputers and programmable interval timers for controlling the phase switching intervals of the pulse motors by counting reference clock pulses in accordance with set values supplied from the microcomputers.

An RADF controller 140 and a sorter controller 150 are connected to the main processor group 71. The RADF controller 140 controls the RAD 2. The sorter controller 150 controls the sorter 200.

The RADF controller 140 for the RADF 2 receives detection outputs from document sensors 44*a* and 45*a* through an input circuit 141, and drives a driving circuit 142 in accordance with signals from the input circuit 141 and control signals from the main processor group 71 so as to control the feed section 41, the reversing section 42, and the convey section 43, thereby automatically conveying documents.

The sorter controller 150 for the sorter 200 receives signals from various sensors 151 such as the non-sort path paper sensor 208 and the sort path paper sensor 209, and controls various loads 153 such as motors for driving the paper path switching solenoid 207 and the convey roller 204 in accordance with input signals from these sensors 151, control signals from the main processor group 171, and the storage contents of a memory 152, thereby performing a sort or non-sort operation.

The sorter 200 will be further described below with reference to FIGS. 5 to 12.

Figure 5:
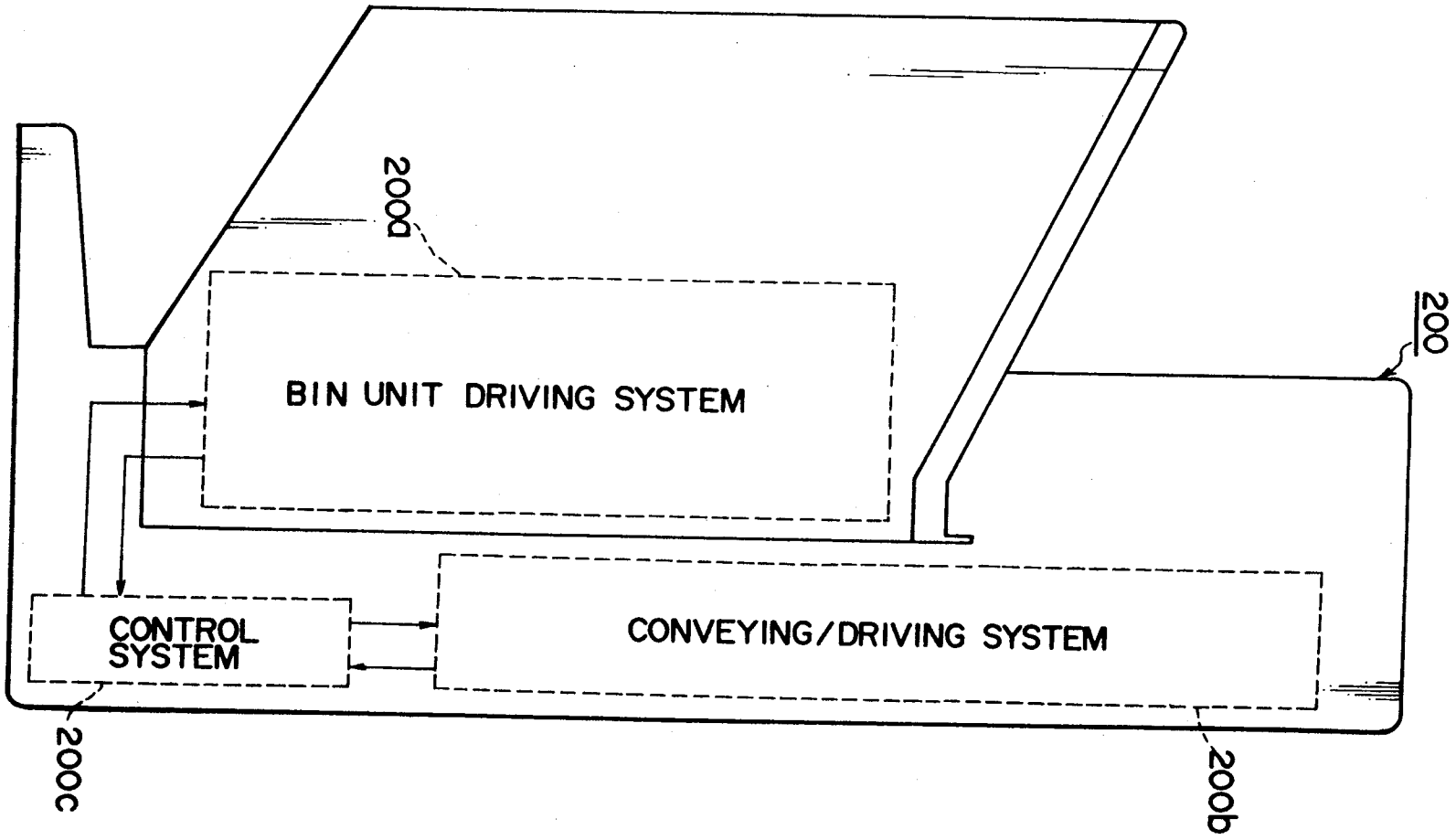
FIG. 5 is a view showing an arrangement of the functions of a sorter.

FIG. 5 shows the basic functional arrangement of the sorter 200.

More specifically, the sorter 200 is roughly divided into three function blocks, i.e., a bin unit driving system 200*a*, a conveying/driving system 200*b*, and a control system 200*c*.

Figure 6:
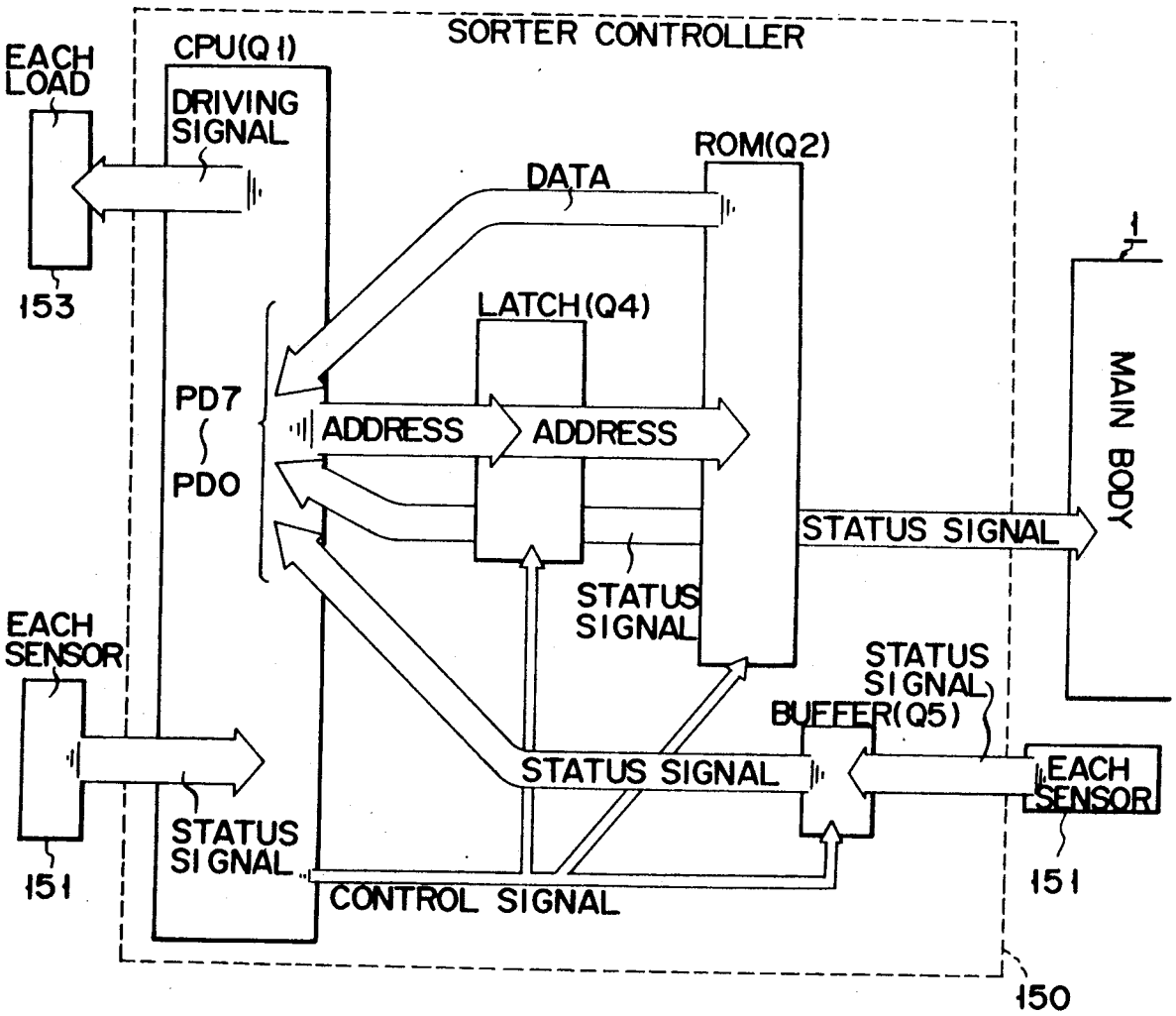
FIG. 6 is a view showing an arrangement of a sorter controller.

FIG. 6 shows an arrangement of the sorter controller 150.

In this arrangement, main control is performed by a CPU (Q1). The CPU (Q1) reads status signals supplied from the sensors 151 and the main body 1, and generates driving signals for the respective loads 153 in accordance with a program.

In addition, a status signal from the sorter 200 is transmitted to the main body 1 in accordance with an operation state.

Figure 7:
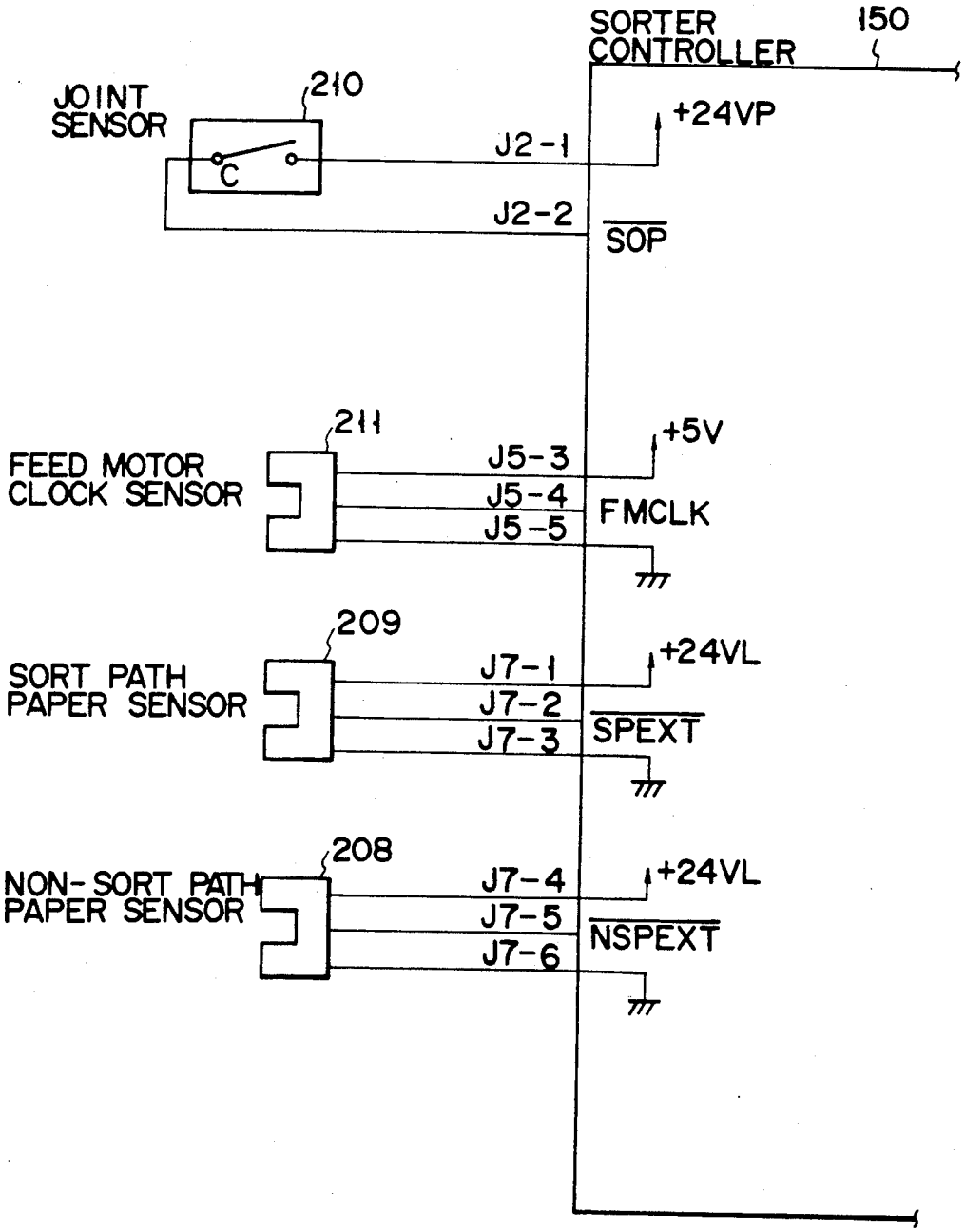
FIG. 7 is a view showing examples of inputs from the respective sensors to the sorter controller.

FIG. 7 shows examples of inputs from the respective sensors 151 to the sorter controller 150.

More specifically, when the non-sort path paper sensor 208 detects a paper sheet, its status signal NSPEXP becomes "0".

When the sort path paper sensor 209 detects a paper sheet, its status signal SPEXT becomes "0".

A joint sensor 210 detects connection with the main body 1. When the sorter 200 is disconnected from the main body 1, a status signal SOP from the sensor 210 is set at "0".

A feed motor clock sensor 211 detects a clock signal from a feed motor (not shown). A status signal FMCLK from the sensor 211 becomes a pulse corresponding to the rotational speed of the feed motor.

Figure 8:
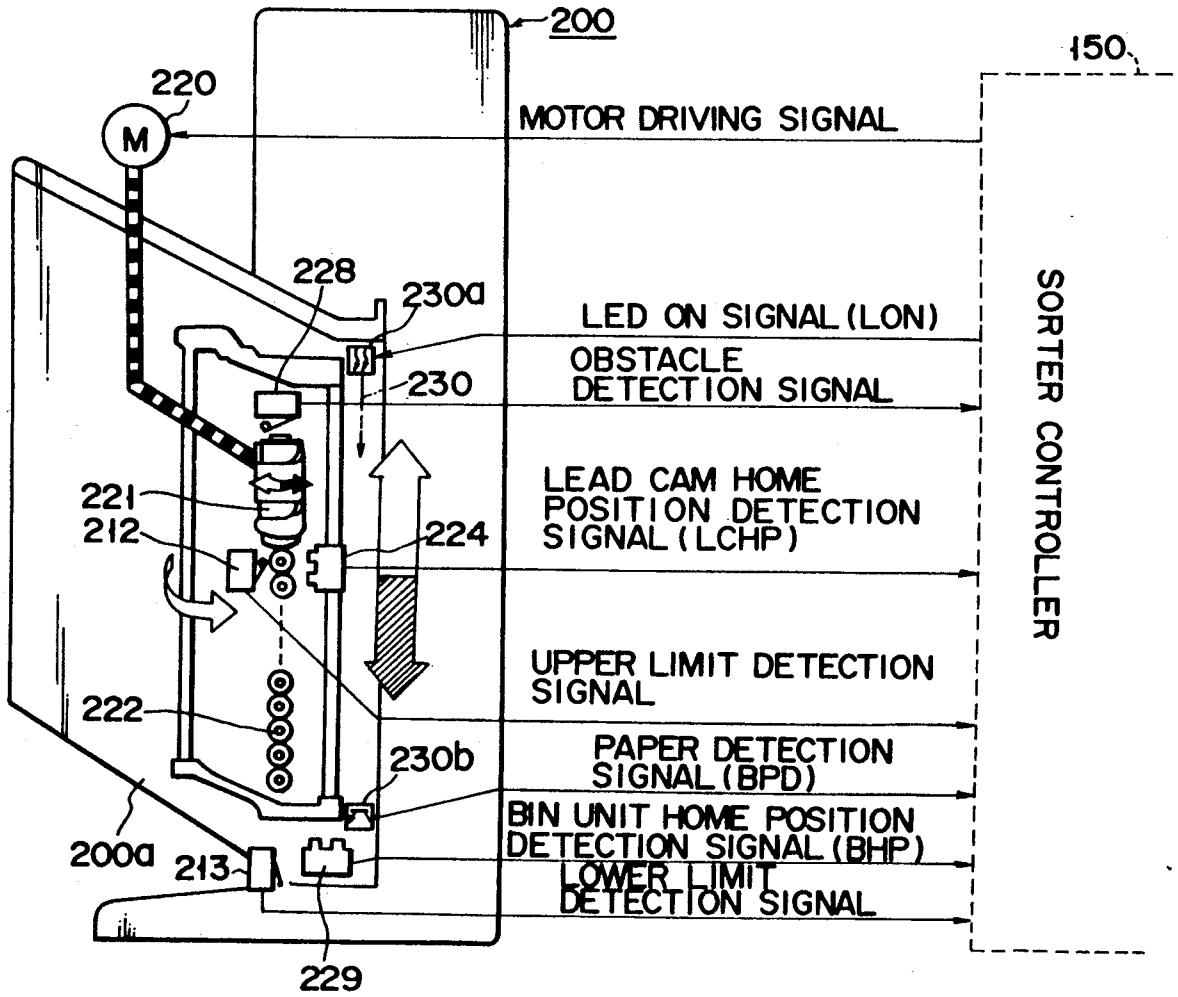
FIG. 8 is a view showing a schematic arrangement of a bin unit driving system.

FIG. 8 shows a schematic arrangement of the bin unit driving system 200*a*.

Each bin 201 of the sorter 200 is driven by a bin shift motor 220 to be vertically shifted (moved).

The upper and lower limits of the movement of each bin 201 are respectively detected by upper and lower limit sensors 212 and 213 constituted by micro switches.

A lead cam 221 is driven by the bin shift motor 220.

When the lead cam 221 is rotated, a roller 222 is vertically moved along the inclination of the lead cam 221. As a result, a bin frame 226 coupled to a fixed roller 225 (see FIG. 2) and the bin 201 coupled to the roller 222 are raised or lowered.

Referring to FIG. 8, reference numeral 228 denotes an obstacle sensor; 229, a sensor for detecting the home position of the bin unit 227; and 230, an intra-bin paper sensor constituted by an LED 230*a*and a photo-transistor 230*b*.

Figure 9:
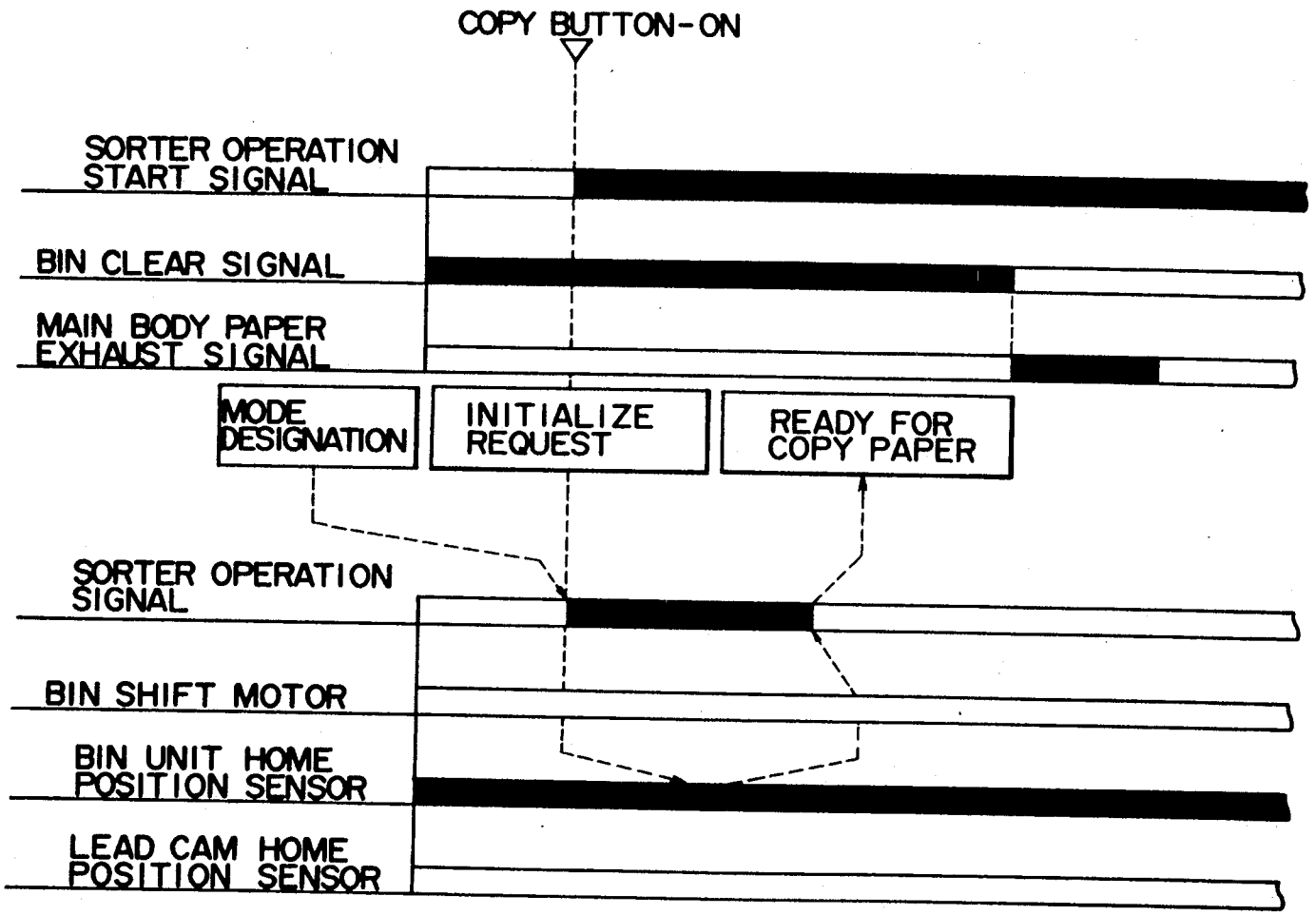
FIGS. 9 and 10 are timing charts for explaining a basic operation sequence of the sorter.
Figure 10:
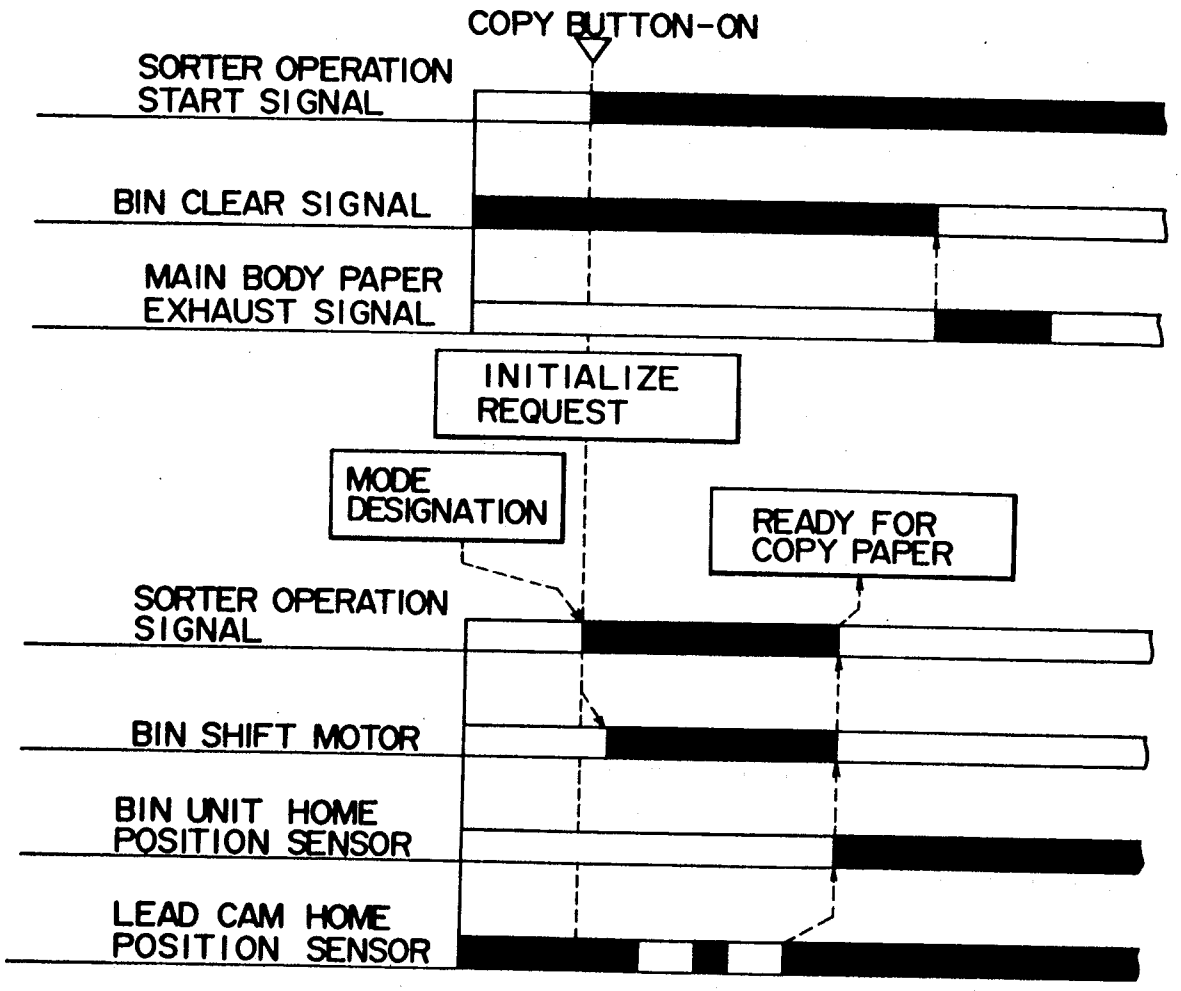

FIGS. 9 and 10 show a basic operation sequence of the sorter 200.

When the copy button 100*a* of the operation panel 100 is turned on, the sorter 200 is initialized by the main body 1 (initialization).

More specifically, when a bin unit 227 is set at the home position, i.e., all paper sheets are removed from the bin unit 227, since the bin unit 227 temporarily returns to the home position, the state shown in FIG. 9 is normally set. In this state, transmission and reception of signals are mainly performed.

In contrast to this, if the bin unit 227 is not set at the home position, i.e., the copy button 100*a* is turned on while the bin unit 227 is not at the home position, the operation shown in FIG. 10 is performed.

Figure 11:
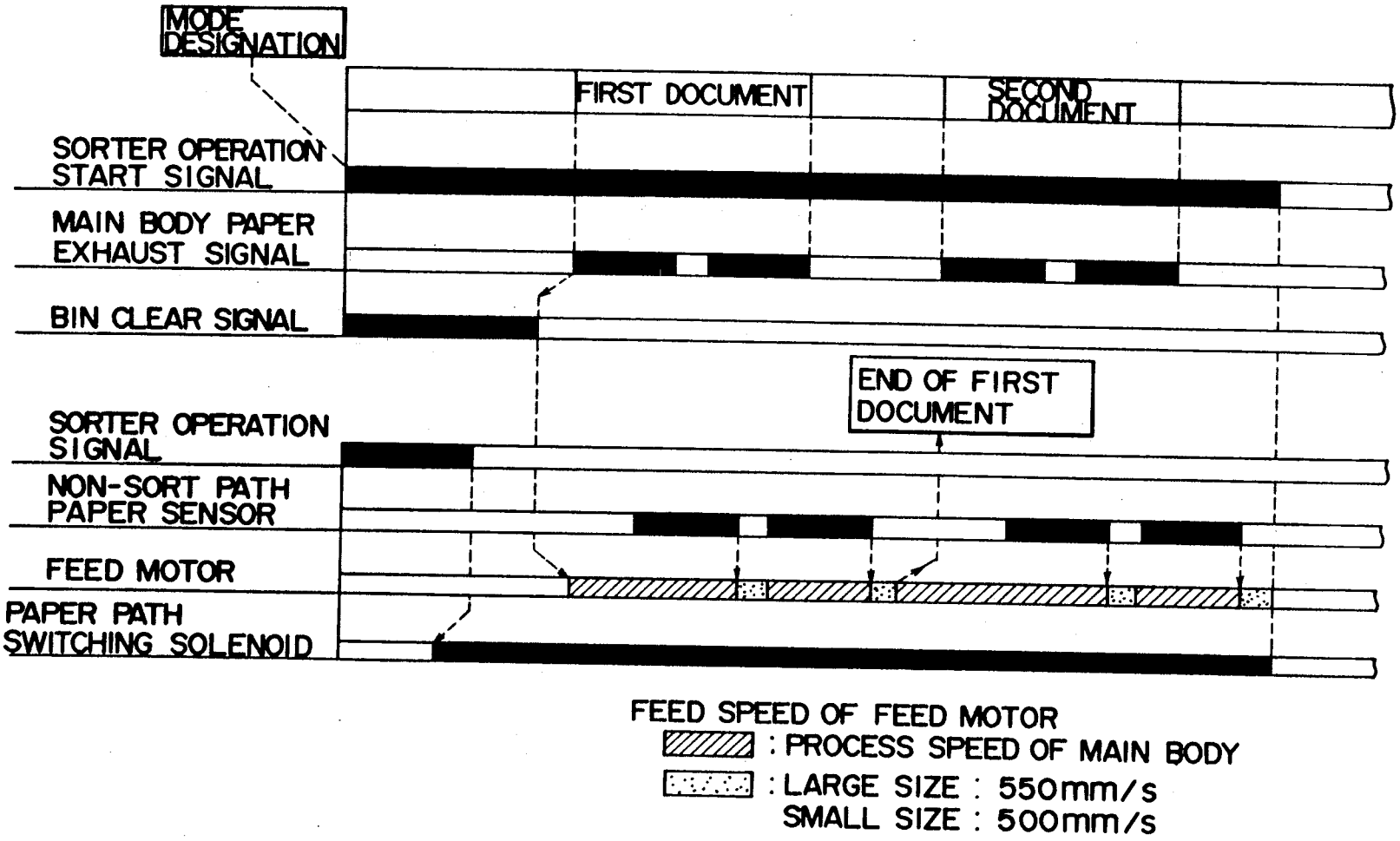
FIG. 11 is a timing chart for explaining an operation in a non-sort mode.

FIG. 11 shows an operation in the non-sort mode.

If a sort operation is not performed, the non-sort mode is designated by the main body 1 when a sort operation start signal rises upon completion of initialization. With this operation, a non-sort path, i.e., a paper exhaust path to the paper exhaust tray 202*z*, is selected. When a paper exhaust signal is enabled, the feed motor is started. Subsequently, when the passage of a paper sheet is detected by the non-sort path paper sensor 208, the speed of the feed motor is reduced, and the paper sheet is exhausted onto the paper exhaust tray 202*z*.

Figure 12:
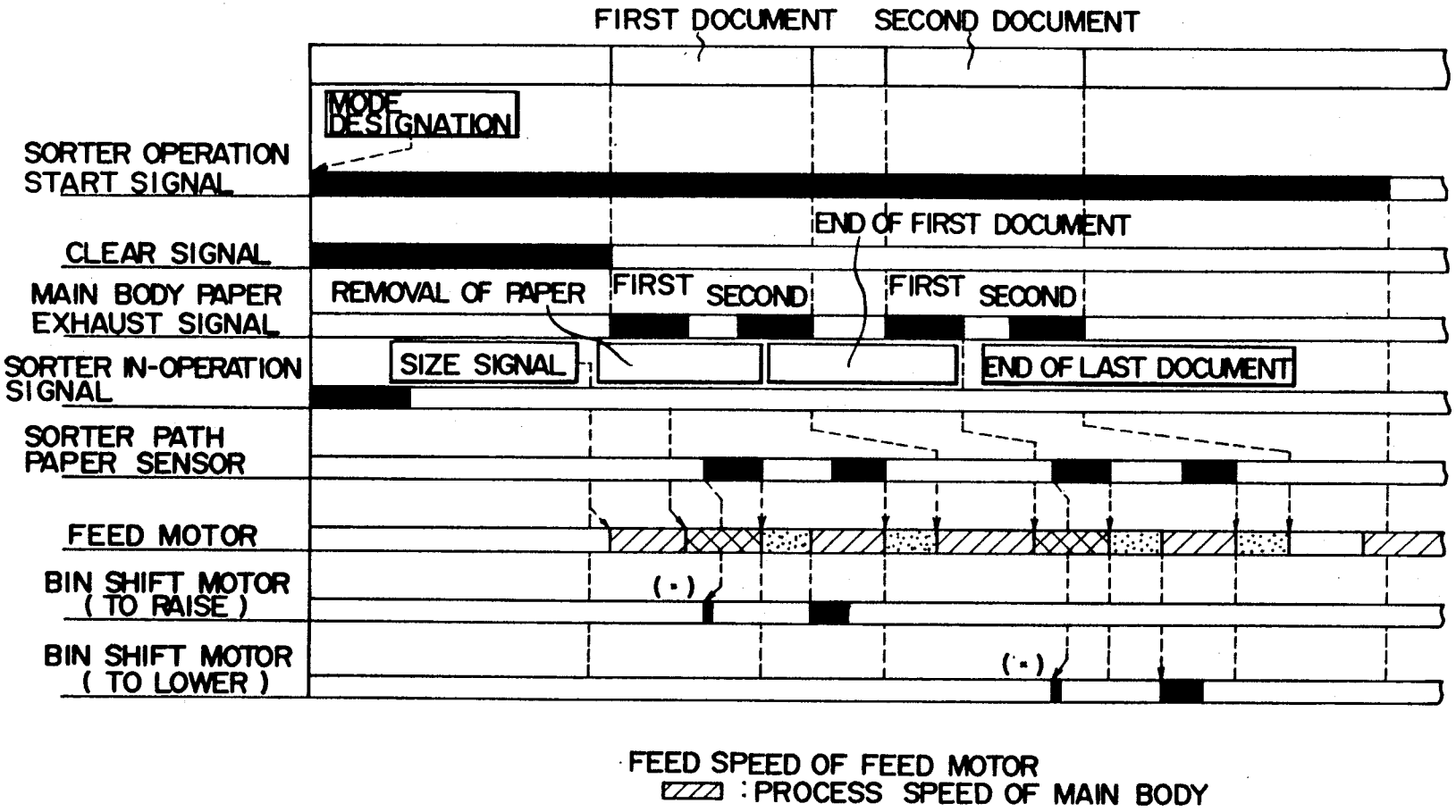
FIG. 12 is a timing chart for explaining an operation in a sort mode.

FIG. 12 shows an operation in the sort mode.

If a sort operation is selected, the sort mode is designated by the main body 1 when a sorter operation start signal rises upon completion of initialization. Subsequently, a signal is transmitted from the main body 1 before a main body paper exhaust signal is output. When the paper exhaust signal is enabled, the feed motor is started.

If the passage of a paper sheet is detected by the paper exhaust detecting switch 38 of the main body 1 in this state, the speed of the feed motor is increased. If the paper sheet is detected by the sort path paper sensor 209, the bin shift motor 220 is turned on to perform preliminary rotation of the lead cam 221. When the passage of the paper sheet is detected by the sort path paper sensor 209, the speed of the feed motor is reduced to exhaust the paper sheet. Thereafter, the lead cam 221 is rotated again to shift the bin 201 upward by one bin interval.

When the bin 201 is shifted to the upper limit, the bin 201 is shifted downward for the next paper sheet. When a paper sheet for the last document is exhausted, the sort operation is completed.

The gist of the present invention will be described next.

Figure 13:
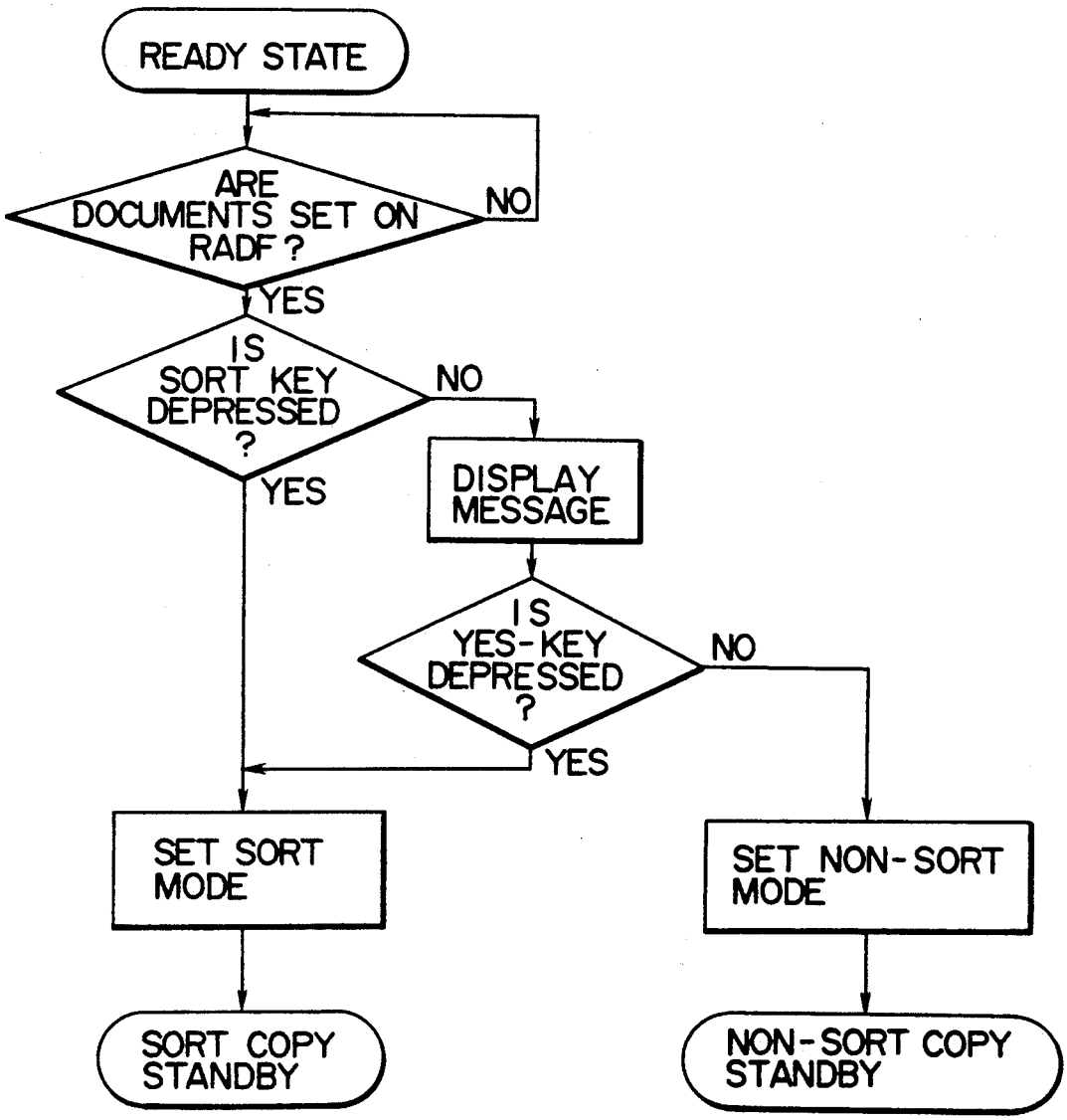
FIGS. 13 to 19 are flow charts for explaining other embodiments of the present invention.

FIG. 13 shows an operation in the above-described arrangement.

Assume that documents are set on the paper feed tray 44 of the RADF 2 by an operator while the electronic copying machine is in a ready state. In this case, the setting of the documents is detected by the document sensor 44*a*. An output associated with this document detection is supplied to the RADF controller 140 through the input circuit 141 and is sent from the RADF controller 140 to the main processor group 71 of the main body 1.

When the main processor group 71 receives the document detection output, it is checked first whether the sort key 100*y* of the operation panel 100 is operated. If the sort mode is selected within a predetermined period of time, the sort mode is designated with respect to the sort controller 150. In addition, the display lamp 100*z* of the operation panel 100 is turned on. With this operation, the sort copy mode is set in a standby state.

Subsequently, the copy button 100*a* of the operation panel 100 is operated to execute the sort operation shown in FIG. 12. That is, as the documents are automatically fed to the document table 5 by the RADF 2, paper sheets on which images are formed by the main body 1 in units of documents in accordance with a designated number of copies are sequentially exhausted into predetermined storage portions of the sorter 200 to be sorted and stacked.

If the sort mode is not selected by the sort key 100*y*, the operator is inquired whether a sort copy operation is performed, In this case, for example, a message "Do you wish to perform a sort copy operation?" is displayed on the display unit 100*c* of the operation panel 100.

Assume that an ON state of the YES key 100*n* is detected within a predetermined period of time during which this message is displayed. In this case, it is determined that the command representing the positive response is entered and the sort mode is selected, and the sort mode is designated with respect to the sort controller 150, as described above.

If an ON state of the YES key 100*n* is not detected, the command representing the negative response is entered and the non-sort mode is designated with respect to the sort controller 150. As a result, the non-sort copy mode is set in a standby state.

Subsequently, the copy button 100*a* of the operation panel 100 is operated to execute the non-sort operation shown in FIG. 11. That is, as the documents are automatically fed to the document table 5 by the RADF 2, paper sheets on which images are formed by the main body 1 in units of documents in accordance with a designated number of copies are sequentially exhausted onto the paper exhaust tray 202*z* of the sorter 200 to be collectively stacked.

As described above, the sort copy mode can be automatically set as needed.

That is, if there is a high probability that a sort copy operation is selected, an operator is inquired whether to select it or not. If a sort copy operation must be selected, switching of modes is forcibly performed. With this operation, inconvenience associated with mode selection can be eliminated to realize a more efficient copy operation. Therefore, copy operations can be performed in proper copy modes regardless of the skill of an operator.

Figure 14:
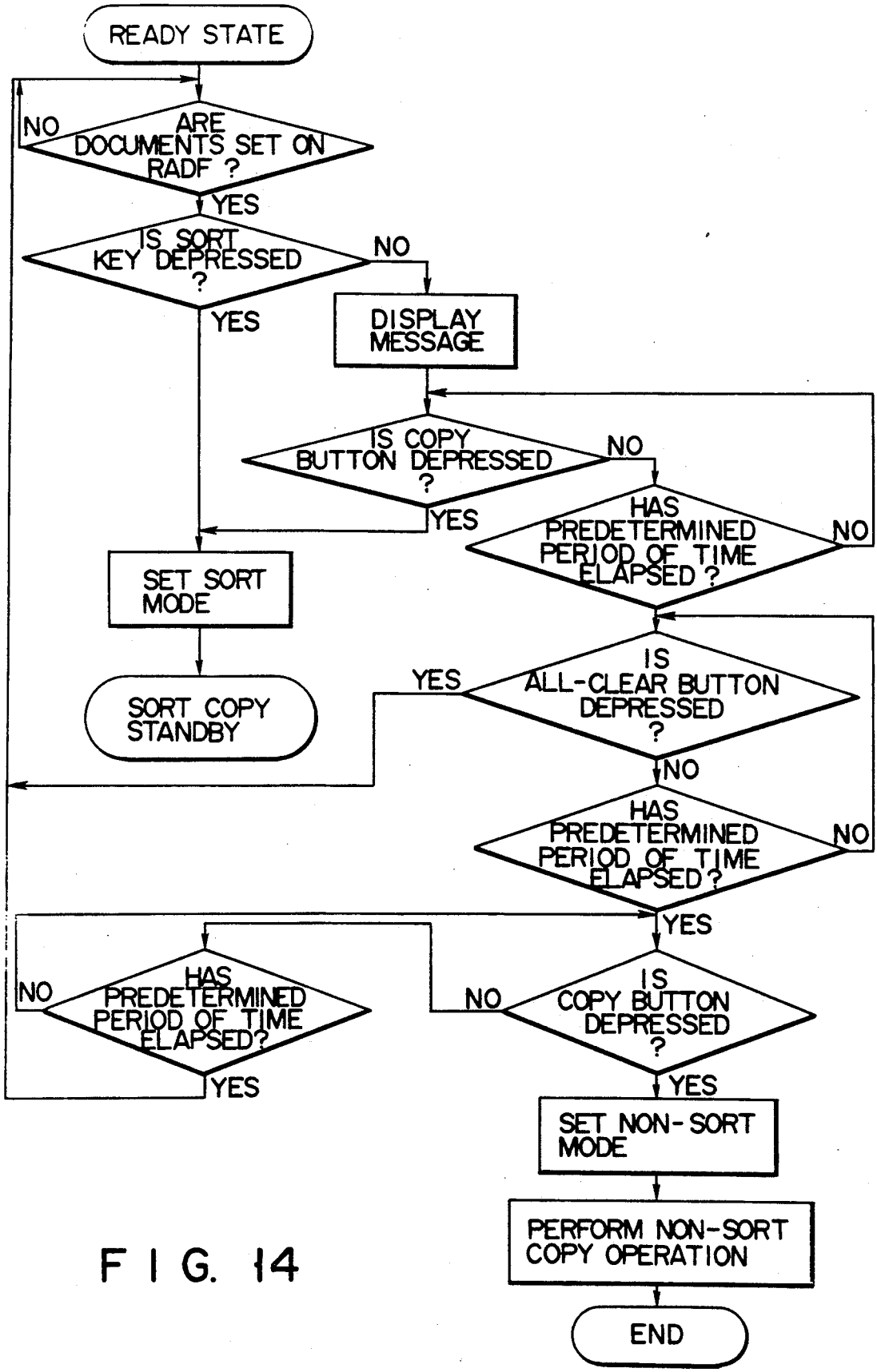

In the embodiment described above, selection of the sort copy mode is determined in accordance with the ON/OFF state of the YES key. However, the present invention is not limited to this. For example, as shown in FIG. 14, this determination may be performed on the basis of the ON/OFF state of the copy button 100*a*. More specifically, it is checked whether the copy button 100*a* is turned on within a predetermined period of time during which a message is displayed. If an ON state of the copy button 100*a* is detected, the sort mode is designated.

Furthermore, in this embodiment, if an ON state of the all clear button 100*m* is detected within a predetermined period of time after an ON/OFF state of the copy button 100*a* is checked, the copying machine is restored to the ready state.

If an ON state of the all clear button 100*m* is not detected, and an ON state of the copy button 100*a* is not detected within the predetermined period of time, a copy operation is executed in the non-sort mode. If an ON state of the copy button 100*a* is not detected within the predetermined period of time, the copying machine is restored to the ready state.

In each embodiment described above, the need for selection of the sort copy mode is determined on the basis of only the setting of documents on the RADF. However, the present invention is not limited to this. For example, as shown in FIG. 15 or 16, this determination may be preformed on the basis of the setting of documents on the RADF and the number of copies.

Figure 15:
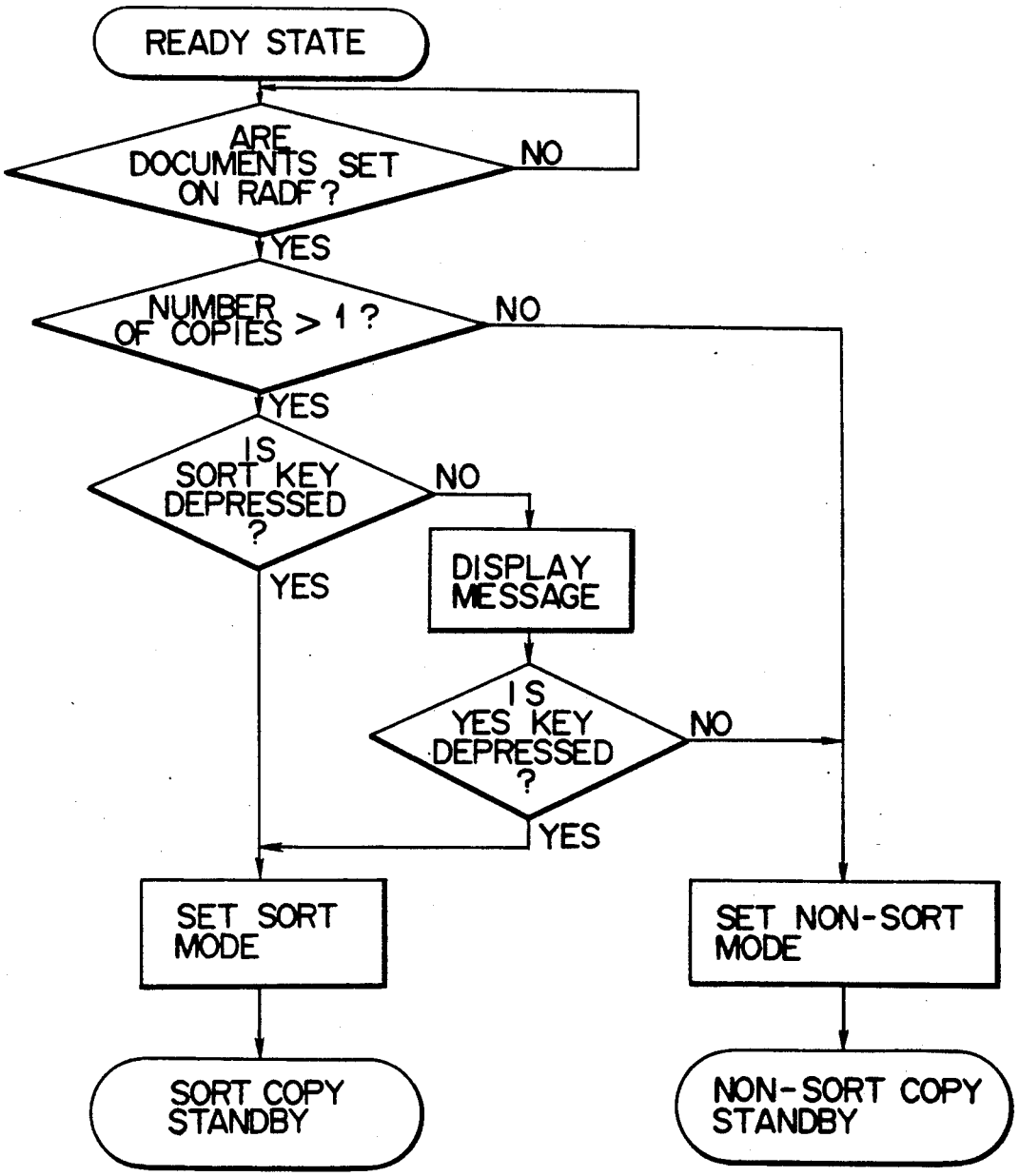

FIG. 15 shows a case wherein a message for inquiring whether to select a sort copy operation is displayed when an ON state of the sort key 100*y* is not detected within a predetermined period of time while documents are set on the RADF 2, and a numeric value more than "1" is set as the number of copies per document. In this case, it is checked whether the YES key 100*n* is turned on within the predetermined period of time during which the message is displayed. If an ON state of the YES key 100*n* is detected, the sort mode is designated. Other wise, the non-sort mode is designated.

Figure 16:
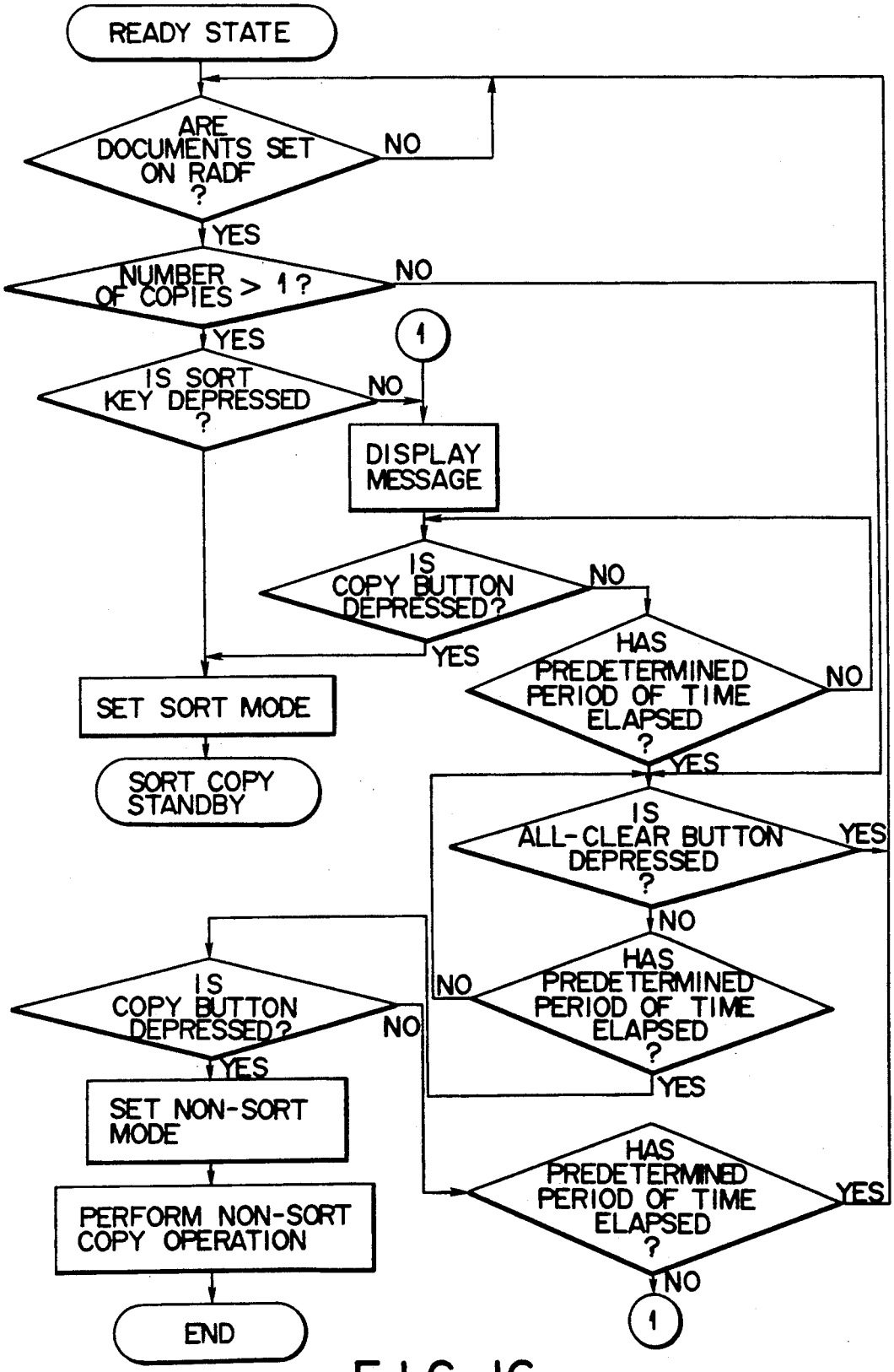

In the case shown in FIG. 16, a message for inquiring whether to select a sort copy operation is displayed on the display unit 100*c* when an ON state of the sort key 100*y* is not detected within a predetermined period numeric value more than "1" is set as the number of copies per document. Furthermore, in this case, it is checked whether the copy button 100*a* is turned on within a predetermined period of time during which the message is displayed. If an ON state of the copy button 100*a* is detected, the sort mode is designated.

In this embodiment, the copying machine is restored to the ready state when an ON state of the all clear button 100*m* is detected within a predetermined period of time after an ON/OFF state of the copy button 100*a* is checked. If an ON state of the all clear button 100*m* is not detected, an ON/OFF state of the copy button 100*a* is checked. If an ON state of the copy button 100*a* is detected, a copy operation is executed in the non-sort mode.

If an ON state of the copy button 100*a* is not detected, processing subsequent to the display of the message is repeated until a predetermined period of time elapses. If an ON state of the all clear button 100*m* and the copy button 100*a* is not detected within the predetermined period of time, the copying machine is restored to the ready state.

In each embodiment described above, an inquiry about the selection of a sort copy operation is made by displaying a message on the display unit. However, the present invention is not limited to this. For example, as shown in FIG. 17 or 18, such an inquiry can be made by causing a display lamp as a sort status display lamp to blink.

Figure 17:
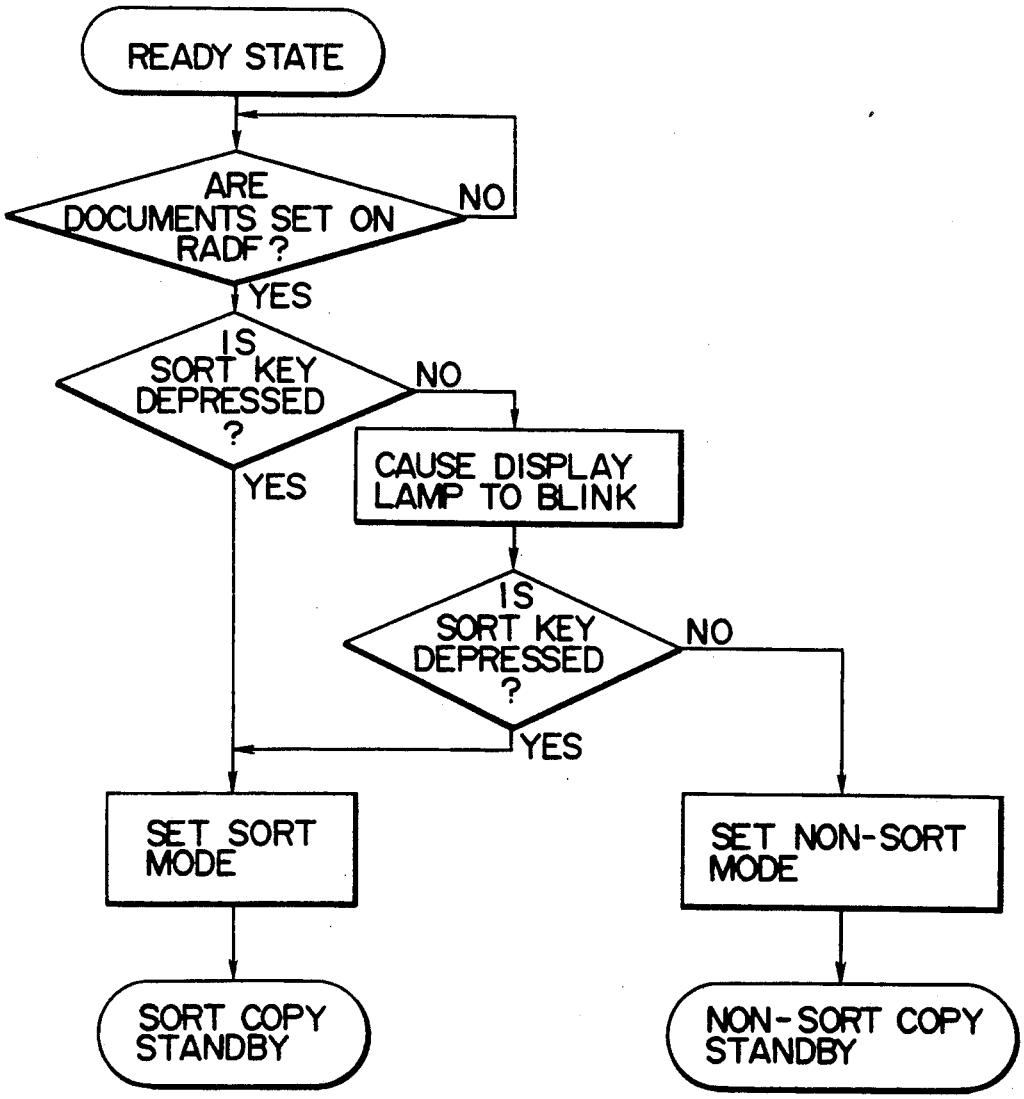

FIG. 17 shows a case wherein an inquiry about the selection of a sort copy operation is made by causing the display lamp 100*z* to blink, when an ON state of the sort key 100*y* is not detected within a predetermined period of time while documents are set on the RADF 2. In this case, it is checked whether the sort key 100*y* is turned on within a predetermined period of time during which the display lamp 100*z* is kept blinking. If an ON state of the sort key 100*y* is detected, the display lamp 100*z* is turned on, and the sort mode is designated. Otherwise, the display lamp 100*z* is turned off, and the non-sort mode is designated.

Figure 18:
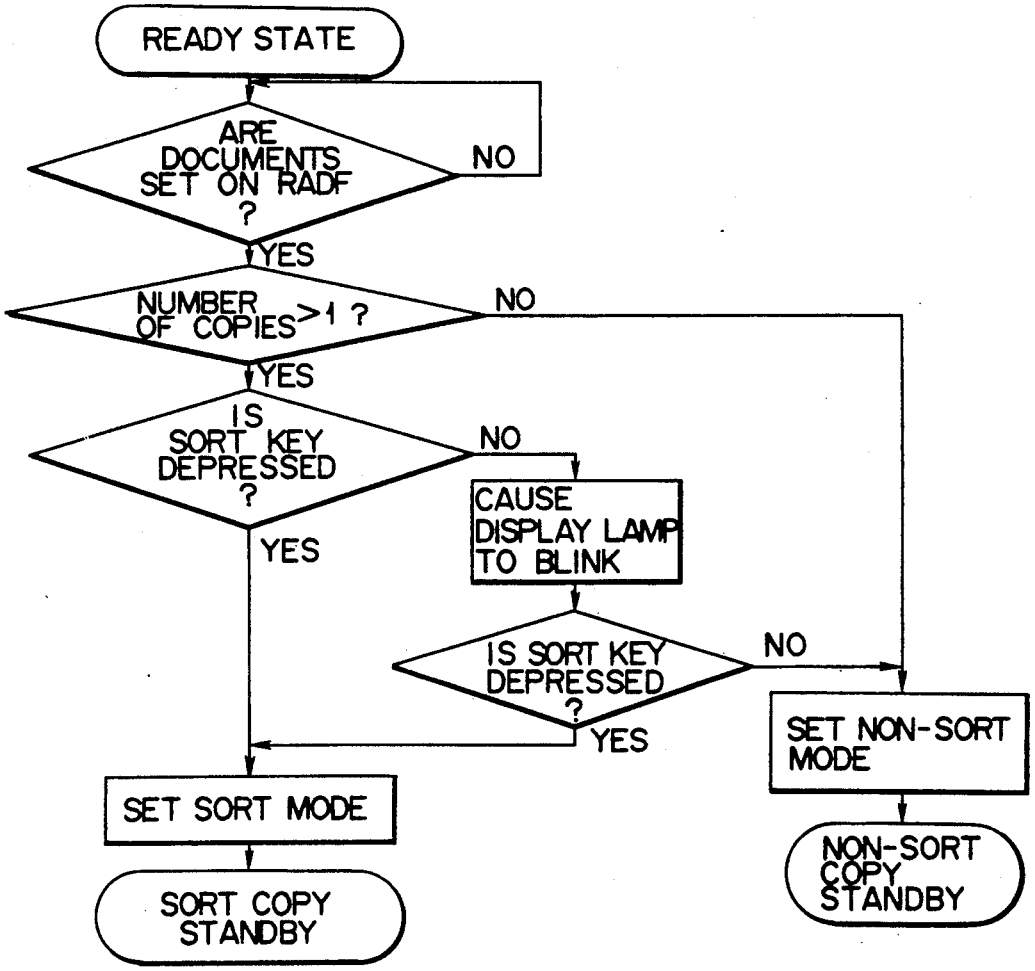

FIG. 18 shows a case wherein an inquiry about the selection of a sort copy operation is made by causing the display lamp 100*z* to blink, when an ON state of the sort key 100*y* is not detected within a predetermined period of time while documents are set on the RADF 2, and a numeric value more than "1" is set as the number of copies per document. In this case, it is checked whether the sort key 100*y* is turned on within a predetermined period of time during which the display lamp 100*z* is kept blinking. If an ON state of the sort key 100*y* is detected, the display lamp 100*z* is turned on, and the sort mode is designated. Otherwise, the display lamp 100*z* is turned off, and the non-sort mode is designated.

In these two embodiments, a mode is selected by the sort key 100*y* while the display lamp 100 is kept blinking. However, similar to the above-described embodiments, the YES key 100*n* or the copy button 100*a* can be used in place of the sort key 100*y*.

Figure 19:
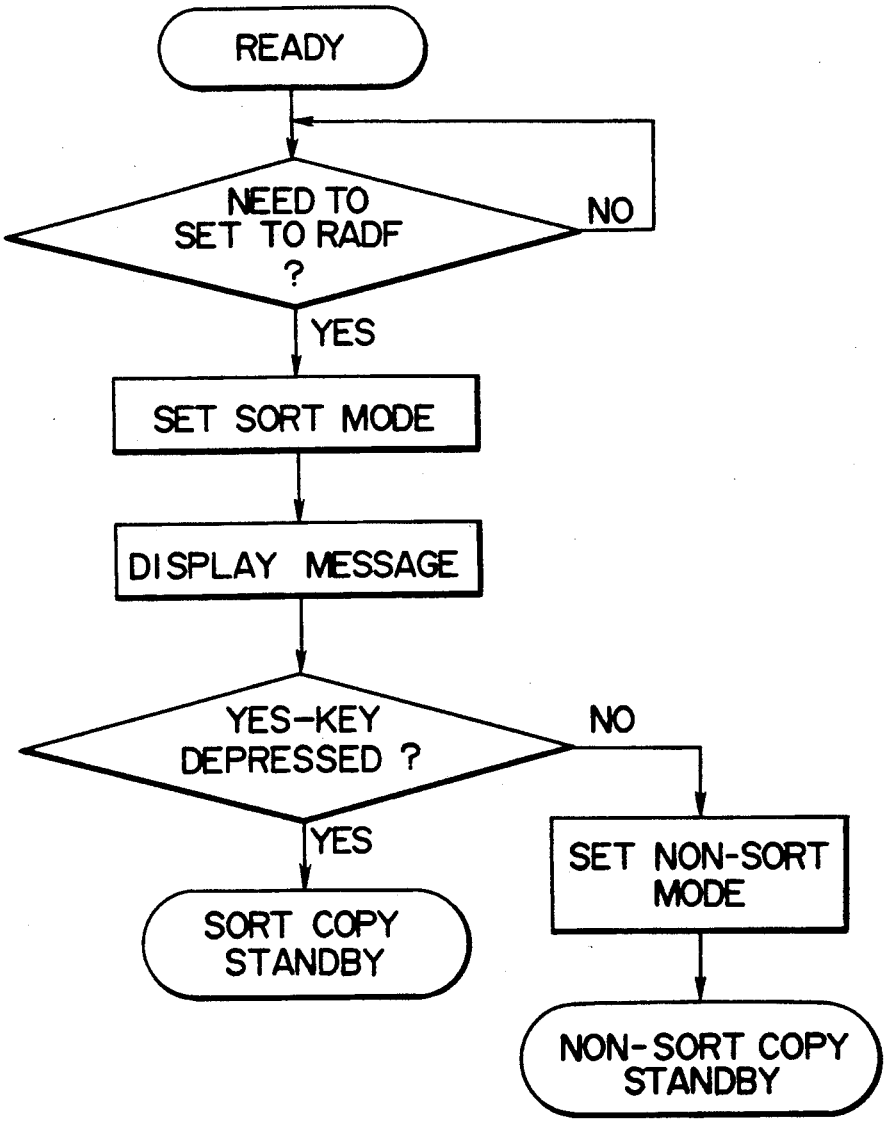

In each embodiment described above, when a setting of documents on a document feed means is detected, an inquiry is made to a user as to whether image forming media for the documents are sorted and stacked on sorting/stacking portions, and the sort mode is set when a sort/stack operation is designated. However, the sort mode may be automatically set if setting of documents is detected before this inquiry, and a user may be asked whether to use the sort mode or not. FIG. 19 is a flow chart showing an operation in such a case.

Various changes and modifications can be made within the spirit and scope of the invention.

As has been described above, in detail, according to the present invention, copy modes can be easily 10 switched in accordance with the need for the selection of the sort/stack mode, thereby providing an image forming apparatus which can properly set the sort/-stack mode, and can efficiently execute an image forming operation.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electronic copying machine comprising:

a platen on which a document having an image is placed;

a return auto document feeder for feeding the document to an image reading position on the platen;

an image scanner for optically scanning the document set at the image reading position;

means for forming an image on a copying material corresponding to an image of the document scanned by said image scanner is formed;

a plurality of bins for receiving the image forming media;

sorting means for sorting the image forming media having the image information formed thereon by said image forming means to the plurality of bins;

means for stacking the image forming media having the image information formed thereon by said image forming means at a predetermined bin of the plurality of bins;

an operation guide key for designating a copy mode of said electronic copying machine, the copy mode including a sorting mode, a stacking mode and a nonsort mode;

guide means for generating guide message data for inquiring whether the sorting and stacking modes are to be set, when a plurality of copies are designated while no sorting and stacking modes are designated;

display unit for displaying the guide message data;

an answer key for designating the sort or stack mode in response to the message displayed by said display unit;

detection means for detecting whether said answer key is operated within a predetermined period of time;

determining means for determining that the sort or stack mode is designated when said detection means detects that the answer key is operated within the predetermined period of time; and means for using a copy button as said answer key.

2. An apparatus according to claim 1, further comprising means for inquiring whether to sort or stack the image forming media, when a plurality of image forming media are set to be formed.

3. An image forming apparatus comprising:

a platen on which a document having an image is placed;

means for forming image information on image forming media from the image of the document on the platen;

a plurality of bins for receiving the image forming media;

sorting means for sorting the image forming media having image information formed thereon by said image forming means to the plurality of bins;

means for stacking the image forming media having the image information formed thereon by said image forming means at a predetermined bin of the plurality of bins;

means for feeding the documents onto the platen from a document setting position for setting the documents;

means for detecting that the documents are set on said document setting position;

means for selectively executing a sorting operation by the sorting means or a stacking operation by the stacking means; and means for inquiring of an operator whether to sort the image forming media by the sorting means instead of stacking the image forming media by the stacking means, when said detecting means detects that the documents are set on said document setting position;

said apparatus further comprising setting means for selectively setting a sorting operation and a stacking operation with respect to said sorting means and stacking means when said detecting means detects that the documents are set on said document feed means;

designating means for designating, in response to an inquiry from said inquiring means, that the sorting and stacking operations are not being performed; and canceling means for canceling the sorting and stacking operations set by said setting means in accordance with the designation from said designating means.

4. The image forming apparatus of claim 3, wherein said inquiring means includes means for performing an inquiring operation when the image information is formed on a plurality of image forming media.

5. An image forming apparatus comprising:

a platen on which a document having an image is placed;

means for forming image information on image forming media from the image of the document on the platen;

a plurality of bins for receiving the image forming media;

sorting means for sorting the image forming media having the image information formed thereon by said image forming means to the plurality of bins;

means for stacking the image forming media having the image information formed thereon by said image forming means in a predetermined bin of the plurality of bins;

means for feeding the documents onto the platen from a document setting position for setting the documents;

means for detecting that the documents are set on said document setting position;

means for selecting a sort mode when said detecting means detects that the documents are set on said document means;

means for inquiring of an operator whether to sort or stack the image forming media having image information formed thereon by said image forming means, when said detecting means detects that the documents are set on said document setting position;

wherein said apparatus further comprises setting means for setting the sorting and stacking operations with respect to said sorting means and stacking means when said detecting means detects that the documents are set on said document feed means; and said setting means includes a first setting key for performing a setting operation before said inquiring means executes an inquiring operation, and a second setting key for performing the setting operation after said inquiring means executes the inquiring operation.

6. An apparatus according to claim 5, wherein said inquiring means includes a display means for displaying a message representing the functions performed by said inquiring means.

7. An apparatus according to claim 6, wherein said second setting key includes means for entering a command representing a positive or a negative response to the message displayed by said display means.

8. An apparatus according to claim 5, further comprising a designating means for designating in response to an inquiry from said inquiring means that the sorting and stacking operations are not performed, and canceling means for canceling the sorting and stacking operations set by the said setting means in accordance with the designation from said designating means.

9. An image forming apparatus comprising:

a platen on which a document having an image is placed;

means for forming image information on image forming media from the image of the document on the platen;

a plurality of bins for receiving the image forming media;

sorting means for sorting the image forming media having the image information formed thereon by said image forming means to the plurality of bins;

means for stacking the image forming media having the image information formed thereon by said image forming means at a predetermined bin of the plurality of bins;

means for feeding the documents onto the platen from a document setting position for setting the documents;

means for detecting that the documents are set on said document setting position;

means for selecting a sort mode when said detecting means detects that the documents are set on said document means; and means for inquiring of an operator whether to sort or stack the image forming media for the image forming media having the image information formed thereon by said image forming means, when said detecting means detects that the documents are set on said document setting position;

wherein said inquiring means makes the inquiry by causing a display unit for displaying a mode status sorting/stacking means to blink.

* * * * *